US008338682B1

(12) United States Patent
Sikra

(10) Patent No.: US 8,338,682 B1
(45) Date of Patent: Dec. 25, 2012

(54) CYMBAL HOLDER WITH BARB MEANS RETENTION OF CUSHION PAD

(75) Inventor: Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 13/200,503

(22) Filed: Sep. 26, 2011

(51) Int. Cl.
*G10D 13/02* (2006.01)

(52) U.S. Cl. ..... 84/422.1

(58) Field of Classification Search ..... 84/422.1, 84/422.2, 422.3, 421
See application file for complete search history.

(56) References Cited

U.S. PATENT DOCUMENTS 4,889,028 A 12/1989 Lombardi
7,663,040 B1 * 2/2010 Hsieh ..... 84/421

* cited by examiner

*Primary Examiner* — Kimberly Lockett

(57) ABSTRACT

In a cymbal support, the combination comprising an axially endwise elongated rod defining an axis, two annular cushioning pads received on the rod, to position a cymbal therebetween, means to hold the pads in controlled compression, axially, there being barb means carried on a sleeve on the rod, to engage the bore region of one of the pads to positively position the bore that pad and to assist compressive positioning of that pad outwardly of its bore area, the other pad compressively and adjustably urged toward the one pad.

11 Claims, 4 Drawing Sheets

CYMBAL HOLDER WITH BARB MEANS RETENTION OF CUSHION PAD

BACKGROUND OF THE INVENTION

This invention relates generally to cymbal controlled support, and more particularly to a combination of components which, when assembled, provides predetermined cushioned and positioning support for a cymbal, while also allowing cymbal angular displacement when struck by a drum stick.

Cymbals have been held for drummer's to strike with a stick by placing them atop a stand. Specifically, the cymbal is placed over a rod and rests on a felt supporting washer. The end of the rod is threaded to accept a nut to hold an assembly of two felts and cymbal. When the nut is tightened to secure the assembly, there is no adjustment of the space between the felts which sandwich the cymbal, thus leaving the drummer to have to adapt to this space which governs the cymbal swing, when struck, and the sound of the cymbal. As drummers decide to control this space they must skim the felt washers or use different sizes of felt; however, with usage the felt will compress and the desired space is lost. There is need for means to automatically control position of felts, and the space between the felts, when components are assembled. This is particularly needed where a single cymbal disc is employed.

SUMMARY OF THE INVENTION

It is a major object of the invention to provide means to meet the above need. Basically, the support for a cymbal comprises, in combination:

a) an axially endwise elongated rod defining an axis, b) two annular cushioning pads received on the rod, to position a cymbal therebetween, c) means to hold the pads in controlled compression, axially, d) there being barb means carried on a sleeve on the rod, to engage the bore of one of the pads to positively position the bore of that pad, and to assist compressive positioning of that pad outwardly of its bore area, the other pad compressively and adjustably urged toward the one pad.

As will be seen, the barb means typically includes at least one annular barb having opposite flanks, one of such flanks located closer to the other pad having angularity $\alpha$, relative to said axis and the other of said flanks having angularity $\beta$ relative to said axis, and where $\alpha<\beta$.

Another object includes provision of a pad axial locating flange on the sleeve, that one pad held in compressive and located engagement with the flange by said d) means, the flange and barb means co-operating to position inner and outer portions of the one pad, for accurately positioning the cymbal and in relation to the other pad.

A further object includes provision of a rotary part threadably engaging the rod and exerting force acting to axially compress the other of the pads and toward the cymbal; the sleeve projecting endwise through an opening in the cymbal, and into the other pad.

These and other objects and advantages of the invention, as well as the details of an illustrative embodiment, will be more fully understood from the following specification and drawings, in which:

DRAWING DESCRIPTION

DETAILED DESCRIPTION

Figure 1:
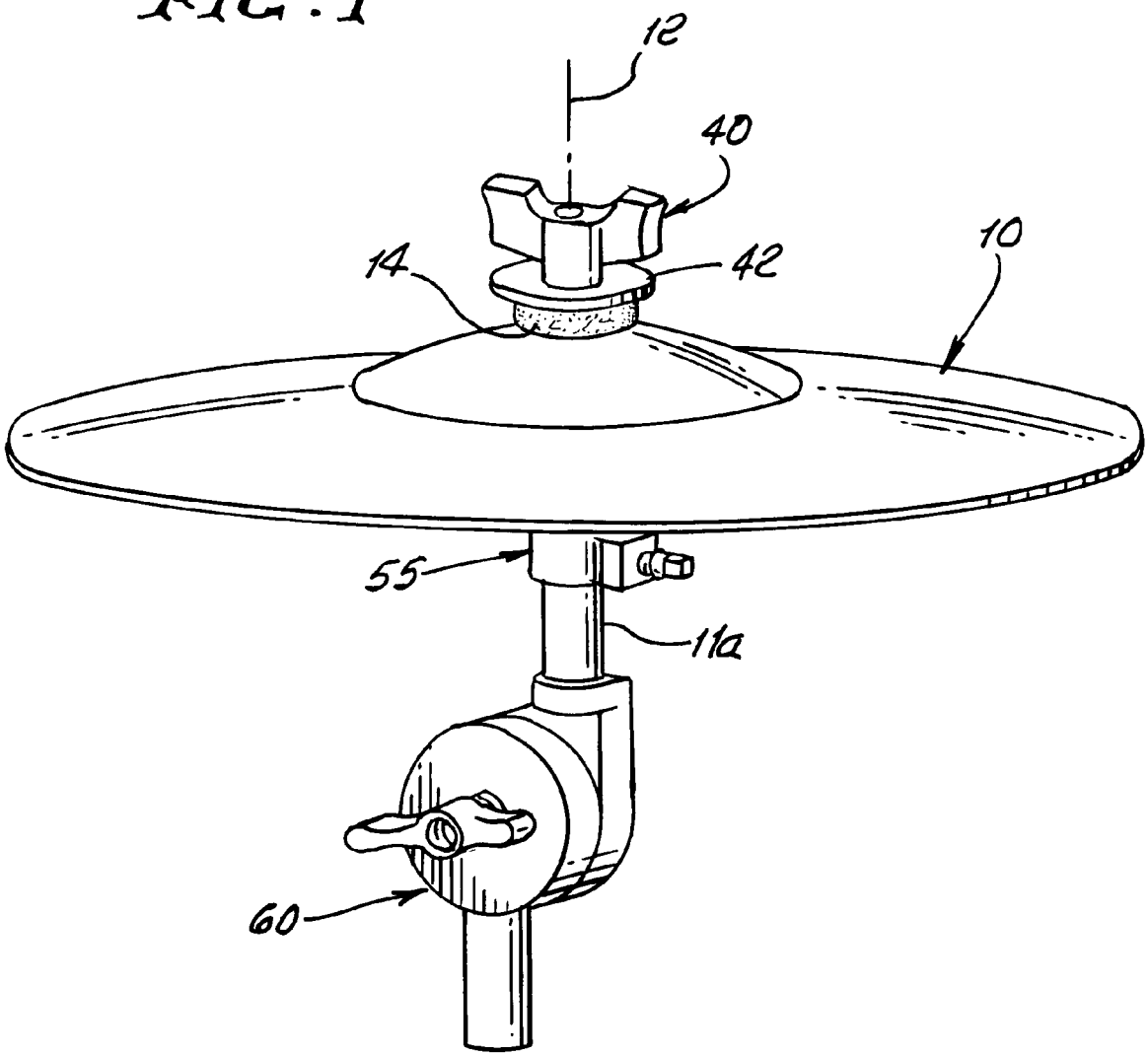
FIG. 1 is a perspective view showing a preferred form of apparatus incorporating the invention.

In the drawings, a thin metallic cymbal disc 10, tiltable when struck, is positioned with respect to an upright axially extending elongated rod 11, defining an axis 12. Two annularly extending, and generally coaxial, longitudinally spaced, cushioning pads, or felts 13 and 14 are received on the rod, to carry the cymbal disc 10 therebetween, as shown. Annular face 13*a* of pad 13 engages side 10*a* of the disc, and annular face 14*a* of pad 14 engages the opposite side 10*b* of the disc, whereby the disc is enabled to yieldably tilt, when struck by a drum stick.

Figure 3:
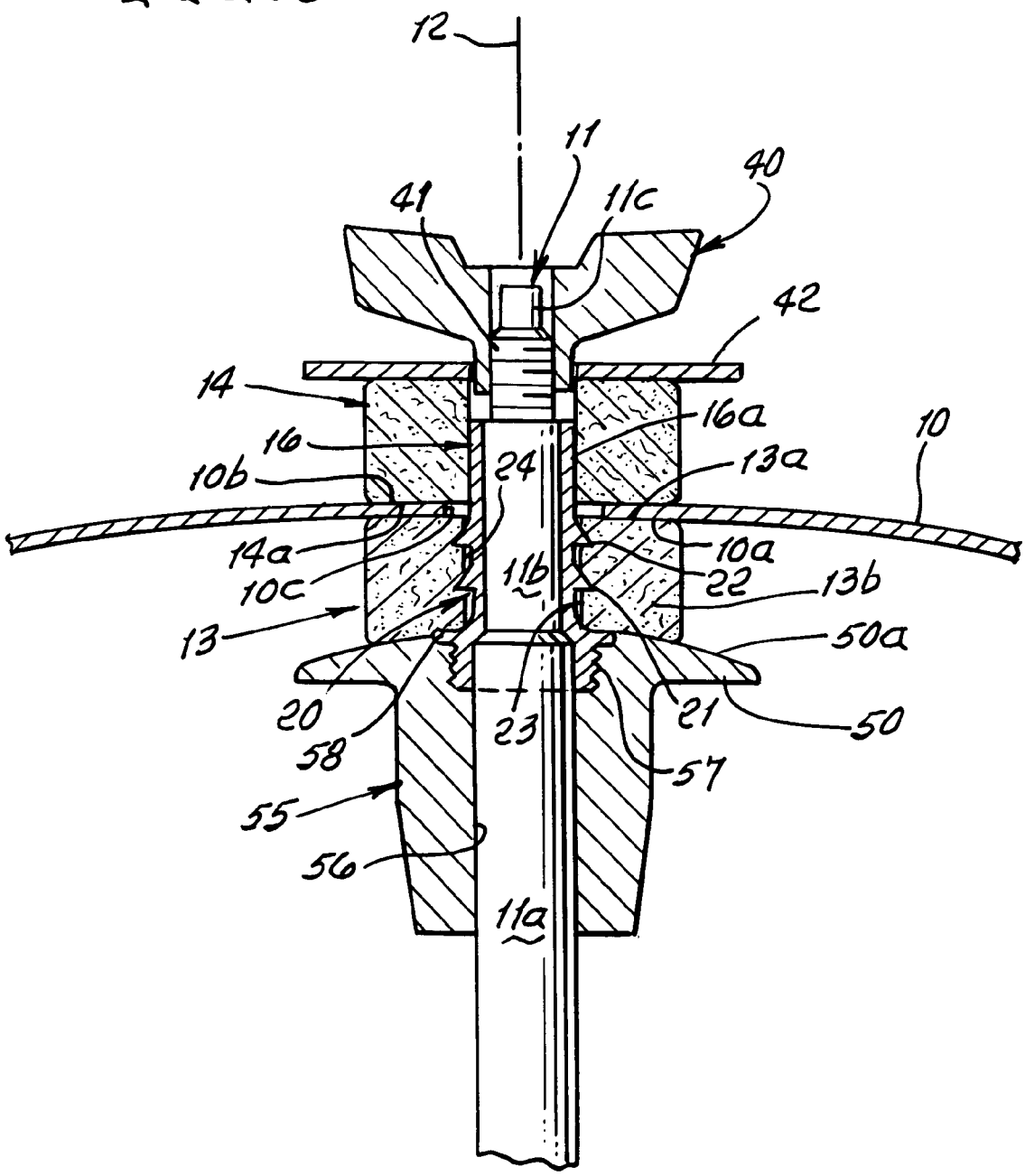
FIG. 3 is an assembly in section showing barb means in positioning relation to related components.
Figure 4:
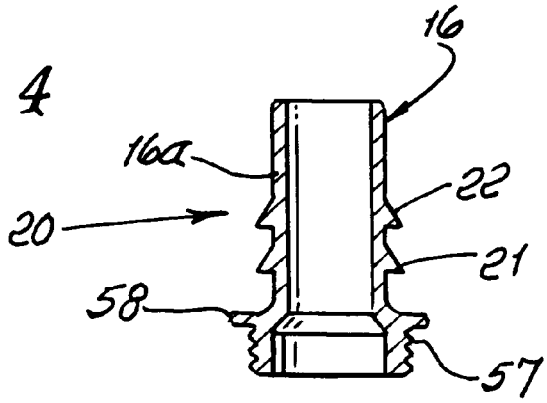
FIGS. 4 and 5 are sections showing carriage of barb means.
Figure 5:
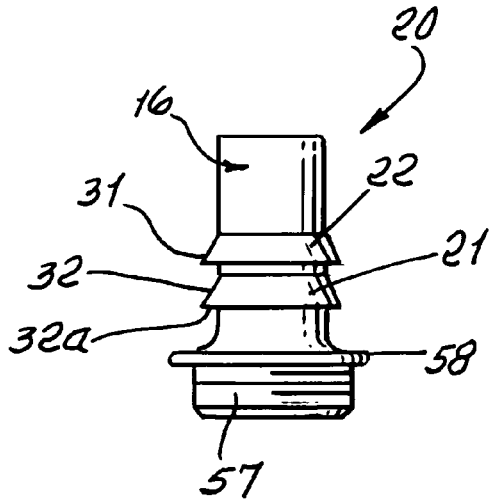

Means is provided to hold the pads in adjustable longitudinal compression, in position as shown in FIG. 3, there being barb means 20 carried on a sleeve 16 on the rod, to engage the bore of one of the pads, i.e. pad 13, to positively position that pad, axially and radially, as at its bore area, and relative to the disc to also allow controlled longitudinal compression of outer extent 13*b* of that pad, assisting its positive positioning. As this occurs, the other pad 14 is compressively and adjustably urged toward pad 13, as shown.

Sleeve 16 is shown as having a tubular extent 16*a* integrally carrying the barb means, in the form of two annular and like barbs 21 and 22, longitudinally spaced apart to engage, and penetrate axially spaced bore portions 23 and 24 of the pad 13. Tips of the two barbs are shown penetrating those pad bore portions. Central opening 10*c* of the disc is sufficiently large to axially pass the barbs, upon assembly.

The like barbs 21 and 22 each have opposite flanks, 31 and 32, flank 32 on barb 21 that is closest to barb 22 having angularity $\alpha$ relative to axis 12; and the other 32*a* of the two flanks having angularity angularly $\beta$ relative to that axis, $\alpha$ being less than $\beta$, i.e. $\alpha<\beta$. Typically, $\alpha$ is between 40° and 60° relative to axis 12, and $\beta$ is between about 80° and 90°. The barbs provide more resistance to pad 13 bore area relative displacement toward pad 14, than resistance to pad 13 bore area axial displacement away from pad 14, positively locating pad 13 bore area relative to the disc and pad 14. However, radially outward extent of pad 13 not penetrates by barbs is more axially relatively movable, allowing more accurate longitudinal adjustment of the two pads relative to the disc. Such adjustment is achieved by rotation of nut 40, threaded at 41 on the rod 11, and carrying pusher disc 42 generally annularly co-extensive with the rightward end of pad 14, whereby turning of the nut in a tightening direction pushes pad 14 down toward the cylindrical disc 10, and pad 13.

The barbs 21 and 22 resist leftward displacement of the bore area of pad 13, but the outer extent of pad 13 tends to transmit pressure down toward and against a flange 50 having convex face 50*a* facing pad 13, allowing greater downward displacement of the outermost extent of pad 13 than the radially mid and inner portion of that pad. In other words, the barbs, and the flange 50 co-operate to control leftward displacement of the pad 13, as pad 14 is tightened toward pad 13, and as disc 10 is retained with cushioning therebetween. this provides for enhanced controlled accuracy of disc positioning as during tilting.

Figure 2:
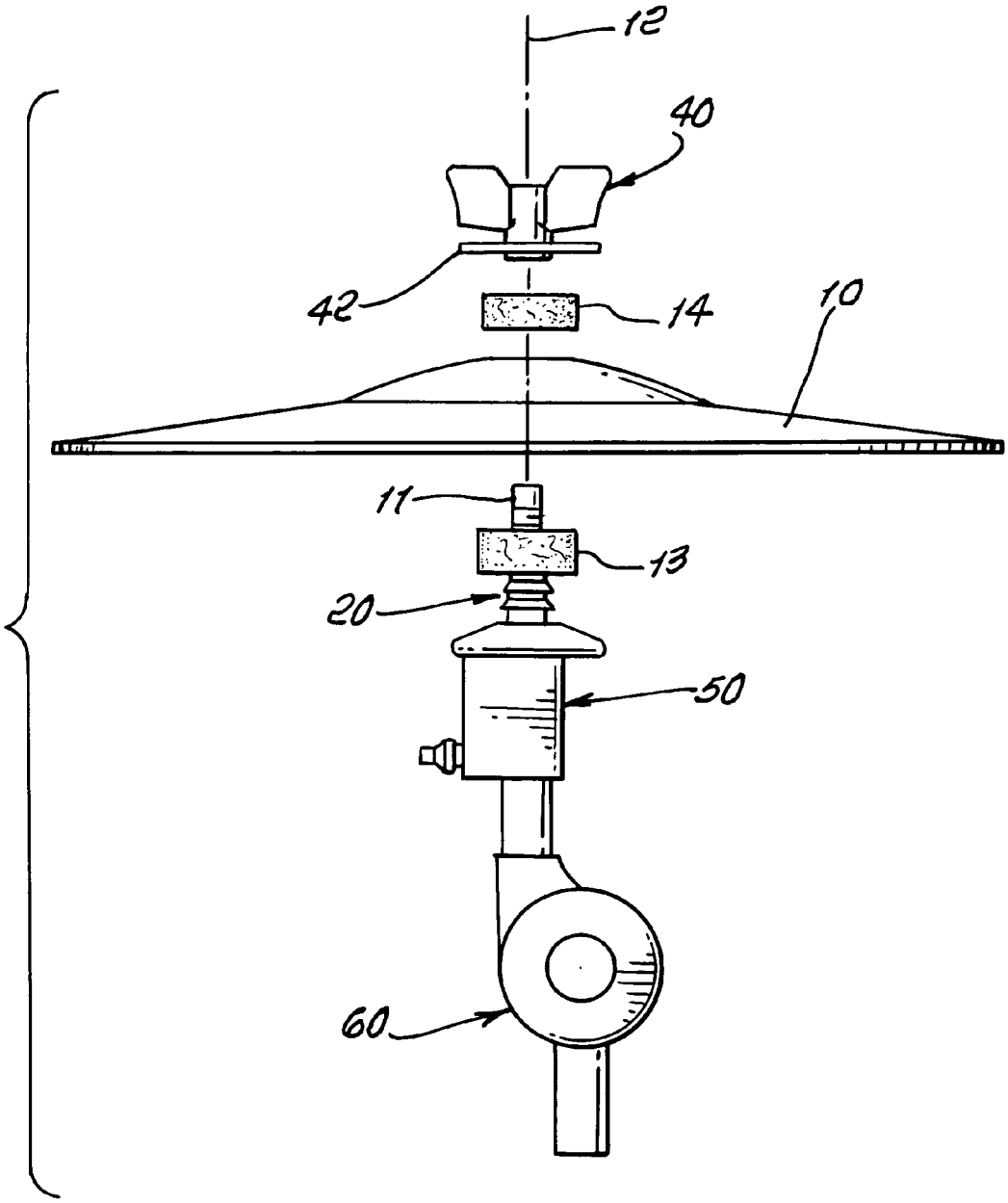
FIG. 2 is an exploded elevation showing components.

Flange 50 is integral with tubular part 55 having a bore 56 receiving rod end portion 11*a*. Rod stepped portions are shown at 11*a*, 11*b* and 11*c*, enabling the effective and compact assembly, as shown. Part 55 has a threaded bore, threaded connected to threaded extent 57 of the sleeve. A positioning sub-flange is shown at 58. A tilting device is shown at 60, in FIG. 2.

I claim:

1. In a cymbal support, the combination comprising:

a) an axially endwise elongated rod defining an axis, b) two annular cushioning pads received on the rod, to position a cymbal therebetween, c) means to hold the pads in controlled compression, axially, d) there being barb means carried on a sleeve on the rod, to engage the bore region of one of the pads to positively position the bore of that pad and to assist compressive positioning of that pad outwardly of its bore area, the other pad compressively and adjustably urged toward the one pad.

2. The combination of claim 1 wherein said barb means includes at least one annular barb having opposite flanks, one of said flanks closer to the other pad having angularity $\alpha$, relative to said axis and the other of said flanks having angularity $\beta$ relative to said axis, and where $\alpha<\beta$.

3. The combination of claim 1 wherein said barb means includes two annular barbs each having opposite flanks, one of the said flanks on each barb closer to the other barb having angularity $\alpha$ relative to said axis, and the other of said flanks having angularity $\beta$ relative to said axis, and wherein $\alpha<\beta$.

4. The combination of claim 3 wherein $\alpha$ is between about 40° and 60°, $\beta$ is between about 80° and 90°.

5. The combination of claim 1 including a flange on said sleeve, said one pad held in compressive and located engagement with said flange by said d) means, the flanged barb means co-operating to position inner and outer portions the one pad, for accurately positioning the cymbal and in relation to the other pad.

6. The combination of claim 5 wherein said d) means comprises at least one barb having a flank extending at an angle $\beta$ to said axis, wherein said flank faces toward said flange, and where $\beta$ is between about 80° and 90°, relative to said axis.

7. The combination of claim 5 wherein said d) means comprises at least two barbs each having a flank extending at one angle $\beta$ to said axis, wherein said angle $\beta$ lies between 80° and 90°, relative to axis.

8. The combination of claim 1 including a rotary part threadably engaging said rod and exerting force acting to axially compress the other of said pads and toward the cymbal.

9. The combination of claim 8, wherein the sleeve projects endwise through an opening in the cymbal, and into said other pad.

10. The combination of claim 9 wherein the rod has threaded extent that projects beyond the sleeve for engagement with rotary part.

11. The combination of claim 1 including means for controllably tilting the rod, and the pads and disc.

* * * * *